United States Patent [19]

Biesinger

[11] Patent Number: 5,060,587

[45] Date of Patent: Oct. 29, 1991

[54] METHOD AND APPARATUS FOR CHANGING THE SPIRAL STITCH PATH IN A TUBULAR FABRIC

[76] Inventor: Peter J. Biesinger, Saumstr. 15, D-7944 Herbertingen, Fed. Rep. of Germany

[21] Appl. No.: 457,555

[22] Filed: Dec. 27, 1989

Related U.S. Application Data

[63] Continuation-in-part of Ser. No. 207,951, Jun. 17, 1988, abandoned.

[30] Foreign Application Priority Data

Jun. 25, 1987 [DE] Fed. Rep. of Germany ..... 3720990
Jun. 15, 1988 [EP] European Pat. Off. ..... 88109517.82304
Jun. 23, 1988 [TR] Turkey ..... 31156/88

[51] Int. Cl.[5] ..... D05B 23/00; D06C 3/00

[52] U.S. Cl. ..... 112/63; 112/262.2; 26/1; 26/82

[58] Field of Search ..... 26/1, 82; 112/262.2, 112/63

[56] References Cited

U.S. PATENT DOCUMENTS

| | | | |
|---|---|---|---|
| 2,321,010 | 6/1943 | Cohn | 26/1 |
| 2,467,281 | 4/1949 | Walter et al. | 26/1 |
| 2,737,700 | 3/1956 | Thompson | 26/1 X |
| 3,203,386 | 8/1965 | Briggs | 26/1 UX |
| 3,430,589 | 3/1969 | Andrauht | 112/262.2 UX |
| 3,472,048 | 10/1969 | Shaw et al. | 26/1 X |

FOREIGN PATENT DOCUMENTS 1339494 12/1973 United Kingdom ..... 26/82

*Primary Examiner*—Peter Nerbun
*Attorney, Agent, or Firm*—Horst M. Kasper

[57] ABSTRACT

A tubular fabric (4) is withdrawn from a supply roll (3), over a spreader (5), by means of a support band (11) and a pressure band (14). The spreader (5) comprises an inner longitudinal guide member (17), and an outer longitudinal guide member (18), and are mounted on the free ends of two or more telescoping tubes (22). The inner and outer guide members are urged apart by helical compression springs and are drawn together by wire cables (26). A cutting device (41), comprising at least one circular knife (43), is disposed between the engaging projections (40) of the guide members (17,18) and the next telescoping tube (22). This cutting device cuts a longitudinal slit (49) in the wall of the tubular fabric, producing two slit edges (51, 52). The lower slit edge (51) lies on the support band (11) and is pressed so as to be held down by the inner guide member (17). The other upepr slit edge (52) lies on the upper side of the inner guide member. It is deflected outwardly, away from the inner guide member in a region between the deflecting rolls (55, 56) by means of a deflecting mechanism (54). Consequently, the upper slit edge (52) passes through a longer path than the lower slit edge (51). The slit edges, which now have been mutually longitudinally displaced, are sewn back together.

53 Claims, 7 Drawing Sheets

Fig.4
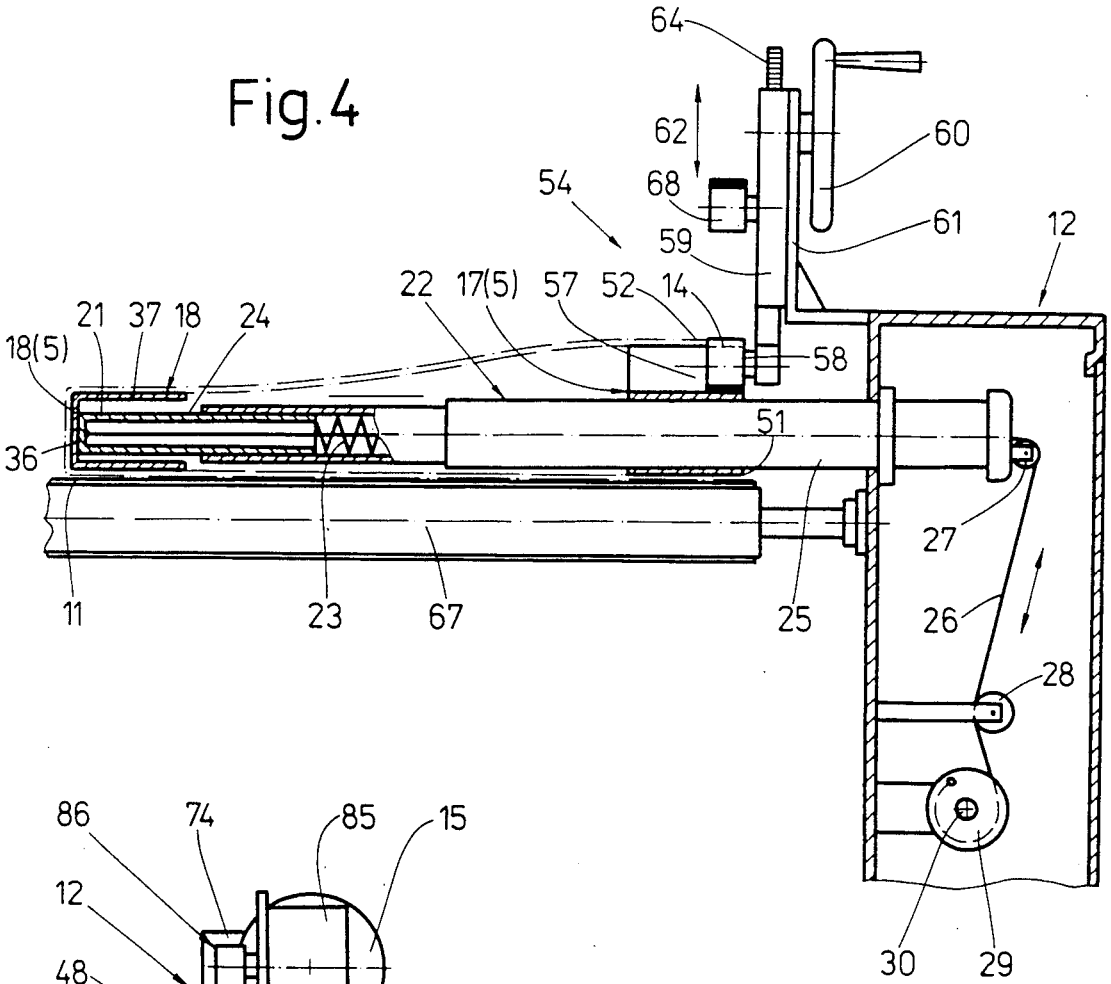
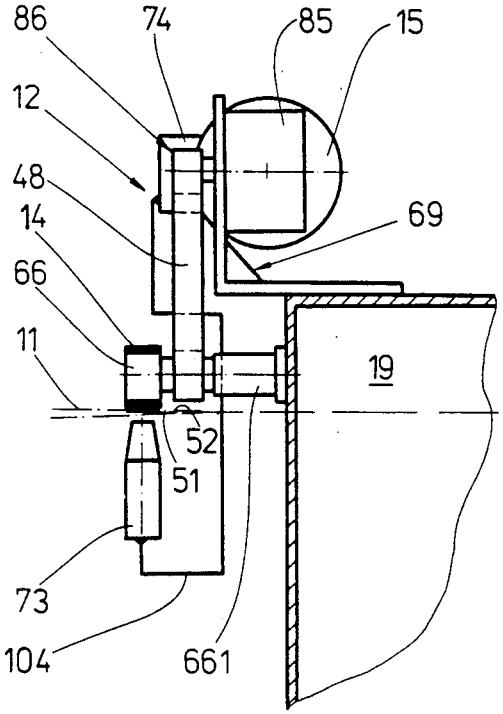
Fig.5

Fig.6
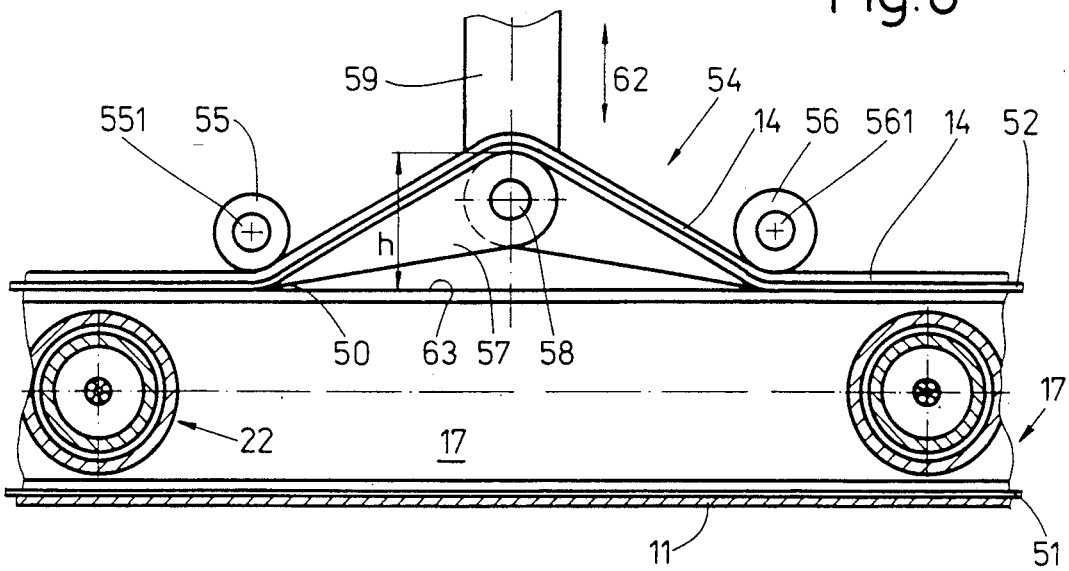
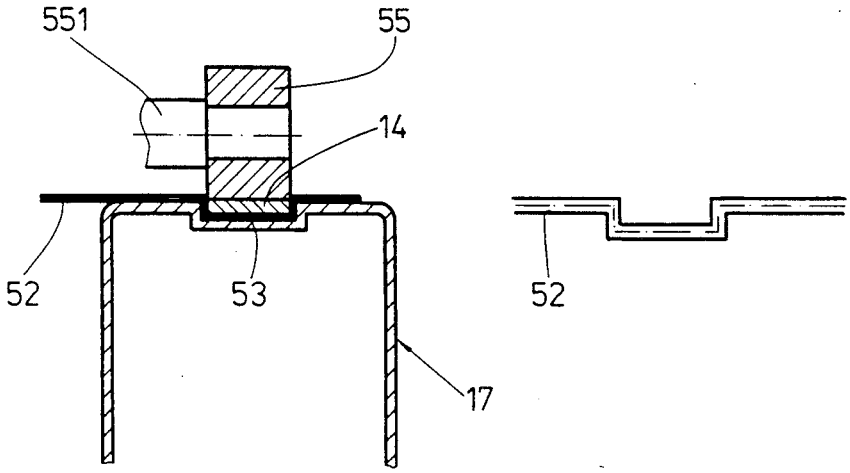
Fig.8

METHOD AND APPARATUS FOR CHANGING THE SPIRAL STITCH PATH IN A TUBULAR FABRIC

CROSS REFERENCE TO RELATED APPLICATIONS

This application is a continuation-in-part application of another application filed June 17, 1988 and bearing Ser. No. 07/207,951, now abandoned. The entire disclosure of this latter application, including the drawings thereof, is hereby incorporated in this application as if fully set forth herein.

BACKGROUND OF THE INVENTION

1. Field of the Invention

The present invention relates to a method and apparatus for changing the spiral stitch path in a tubular fabric.

2. Brief Description of the Background of the Invention Including Prior Art

Tubular textile goods are as a rule manufactured on circular knitting machines, wherein a plurality of knitting needles are disposed on the perimeter of a cylinder and are actuated in a cyclic succession wherein each needle forms one stitch. In the process, the yarn is moved in the circumferential direction and there is an axial advance by the distance of approximately one stitch width. If the machine has one hundred needles on the perimeter, and the stitch width is 1 mm, then the total advance for one circuit is 100 mm. If the tubular piece lies flat, then for each outer side (front and rear) the advance will be, for example, 50 mm.

Thus, the path of the successive stitches in a tubular fabric is a spiral around the tube. For a single-color piece, if thin yarn is used, this spiral configuration would not have an exaggerated appearance. However, the thicker the yarn is and the more discernible the individual "cross runs" are, the more problematical is the spiral configuration, particularly when there are contrasting differences in brightness or color such as are present in fashionable horizontally striped tubular knitwear, such as hosiery, sweaters, and other garments.

To alleviate the problem, in the past, the knit "spiral tubular piece" has been cut along a longitudinal line, wherewith the entire piece was folded over in a plane and the cut edges were mutually shifted by the distance of one pitch of the spiral. The cut edges would then be sewn together. The piece would then be further processed, as be being sent to the cutting table, on a single surface.

This is a satisfactory procedure in small-shop production and manufacturing, but in machine knitting it occasions substantial expense and decreases production capacity. Therefore, it is unsuitable for large-scale factory use. Because the form of such a textile piece is so unstable, because it is difficult to align and keep aligned before it is sewn back together, in practice, it has been nearly impossible to completely remove the slant when joining the stripes so as to produce items of clothing, wherein the transverse, and in particular the cut edge, has been in accurate alignment at the cut edge.

The company ELTROTEC Elektro-GmbH, P.0. Box 1241, D-7060 Schorndorf, provides a fasop catalog issued in October 1985 and illustrating elements useful for constructing opto-electronic installations. Furthermore, the company ERNI+CO AG, Elektro-Industrie, CH-8306 Brüttisellen (Zürich) furnishes flyers dated October 1986 relating to set point - actual value comparison testing in production situations.

The company bitexma Maschinen- und Anlagenbau GmbH, D-7944, Herbertingen, Federal Republic of Germany, provides a catalog relating to a machine to correct the spirality in striped tubular knitted fabrics, issued in September 1987.

SUMMARY OF THE INVENTION

1. Purposes of the Invention

It is an object of the invention to provide a process where the tubular fabric is supplied to a work station in its original spiral form.

It is a further object of the invention to provide a process where the fabric, after passing through the work station, exhibits stitch paths of a circular shape.

It is yet another object of the invention to provide an automatic work station employing a tubular fabric and producing an annular stitched product.

These and other objects and advantages of the present invention will become evident from the description which follows.

2. Brief Description of the Invention

The present invention provides for an invention method comprising the following steps:

a) The tubular fabric is continuously advanced in its longitudinal direction over an inner guide means;
b) The tubular fabric is cut along a longitudinal straight line, forming two cut edges;
c) The two cut edges are then advanced over different distances and/or at different speeds, employing two separate advancing mechanisms;
d) Thereby the two cut edges become mutually displaced in the longitudinal direction;
e) The edges are then moved together in a direction transverse to the conveying direction; and
f) The edges are further advanced in tandem, during which they are rejoined in the longitudinally displaced position which has been produced.

In this way it is fundamentally possible to have a continuous operation from the feed to the release of the fabric into and out of the work station, respectively. The ultimate longitudinal seam may be configured such that it is not noticeable from the exterior. The spiral strips are changed from elongated parallelograms to rectangles, without force. Thus, it is seen that the inventive method can be advantageously inserted and interposed in the manufacturing line. Only minimal time and operating expense is required, and relatively simple equipment may be employed. Accordingly, the cost of carrying out the method is modest. An exact correction of the yarn path can be achieved. The method is particularly suited for automation with modern industrial machinery.

The material in tubular form is substantially stronger and more stable than in single-layer flat form. This makes it possible to more easily and accurately correct the spiral pitch and align the ends of a stripe when rejoining the tube. This tubular form also facilitates further processing and reduces the cost of said processing. In particular, less costly equipment can be used.

In accordance with the preceding discussion of the method, particularly as accomplishable by simple equipment and steps, an apparatus for changing the spiral stitch path in a tubular fabric, for example, a fabric produced on a circular knitting machine, particularly an apparatus for carrying out the above-described method, is provided with the following features:

A machine frame, bearing the following items:

a) Interior guide for the tubular fabric;

b) At least one conveying mechanism for continuously conveying the tubular fabric over the guide;

c) A cutting device disposed in the region of the interior guide, for cutting the tubular fabric in the direction of advance;

d) Separate guide means for guiding the two cut edges bordering the longitudinal slit, such that said edges move over different lengths of advance or at different speeds, whereby said edges are mutually displaced from their former reference positions and are advanced in their mutually displaced condition; and e) A joining device for rejoining the said cut edges after they have been brought together, to produce a tubular form, during the continued conveying advance of said edges.

The apparatus parts and components referenced here, along with the necessary automatic control, are in general available in proven embodiments, and in the stated combination are fundamentally suitable for changing spiral stitch paths, particularly in a tubular fabric or the like.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 4 is partial cross-section through lines IV—IV, respectively, of FIG. 1;

FIG. 5 is a partial cross-section through lines V—V of FIG. 1;

FIG. 6 is an enlarged end view detail of location VI of FIG. 1; and

FIG. 8 is a partial sectional view of the embodiment of FIG. 1 along section line VIII—VIII.

DESCRIPTION OF INVENTION AND PREFERRED EMBODIMENT

Figure 1:
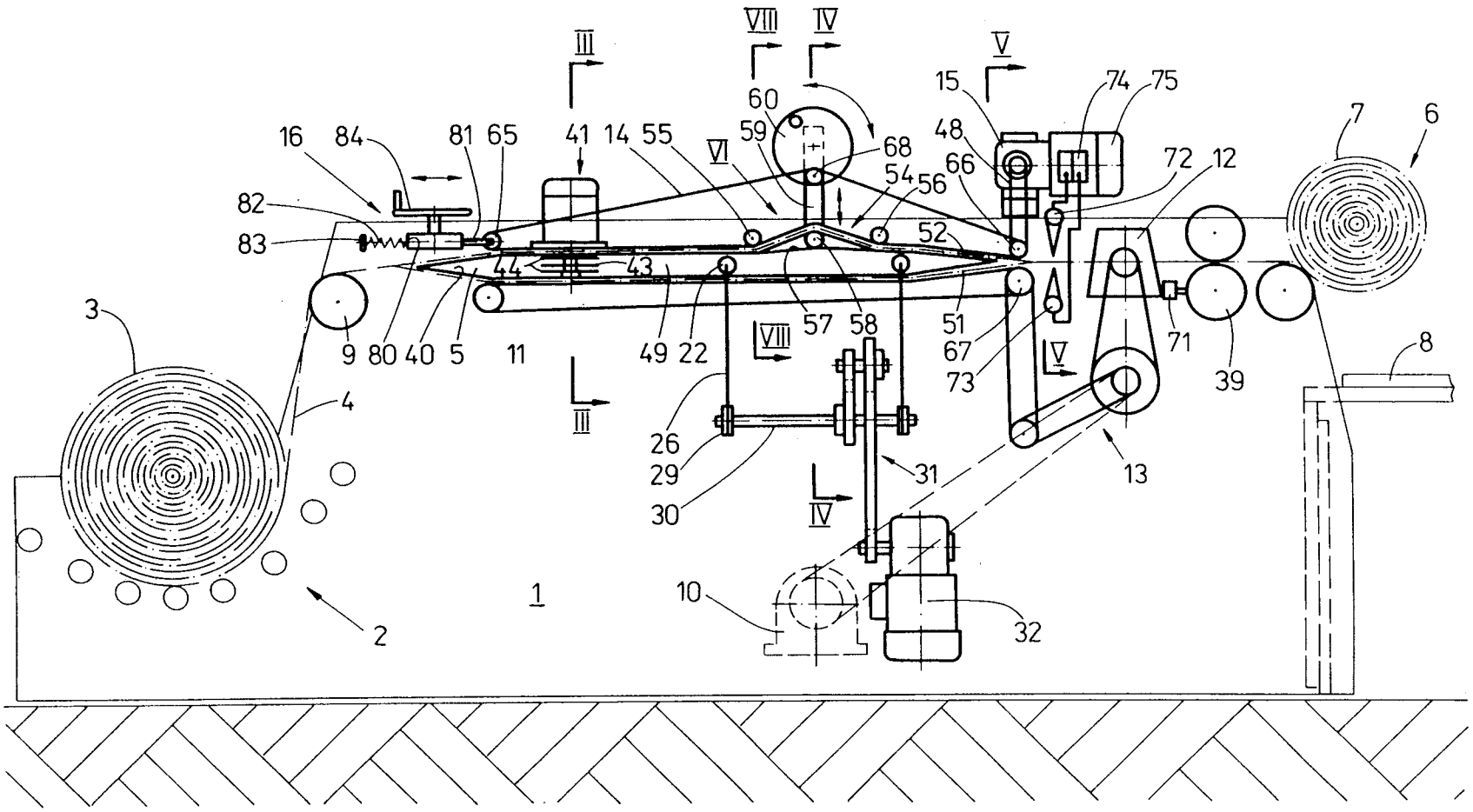
FIG. 1 is a schematic side view of an apparatus for inventively guiding and processing a tubular fabric.

Machine frame 1, having two lateral supports, namely an inner support 19 and an outer support 20, bears the supply roll 3 of a tubular fabric 4, which roll is mounted in a roller basket 2 on the feed side of the apparatus. The tubular fabric 4 is pulled over a spreader 5 during the following processing, and is taken up on a take-up device 6 which has a winding roll 7. The tape-up device 6 may also be provided with a laying device for the table 8.

A support band 11 for the spreader 5 forms a first advancing organ which, along with a sewing machine 12, is driven from the main motor connected to the advancing drive 10 via a tension-type drive 13, for example a belt or a chain drive.

A second advancing device is formed by pressure band 14 driven by a second advancing motor 15. Band 14 may be held under adjustable tension by means of a tensioning device 16.

Figure 2:
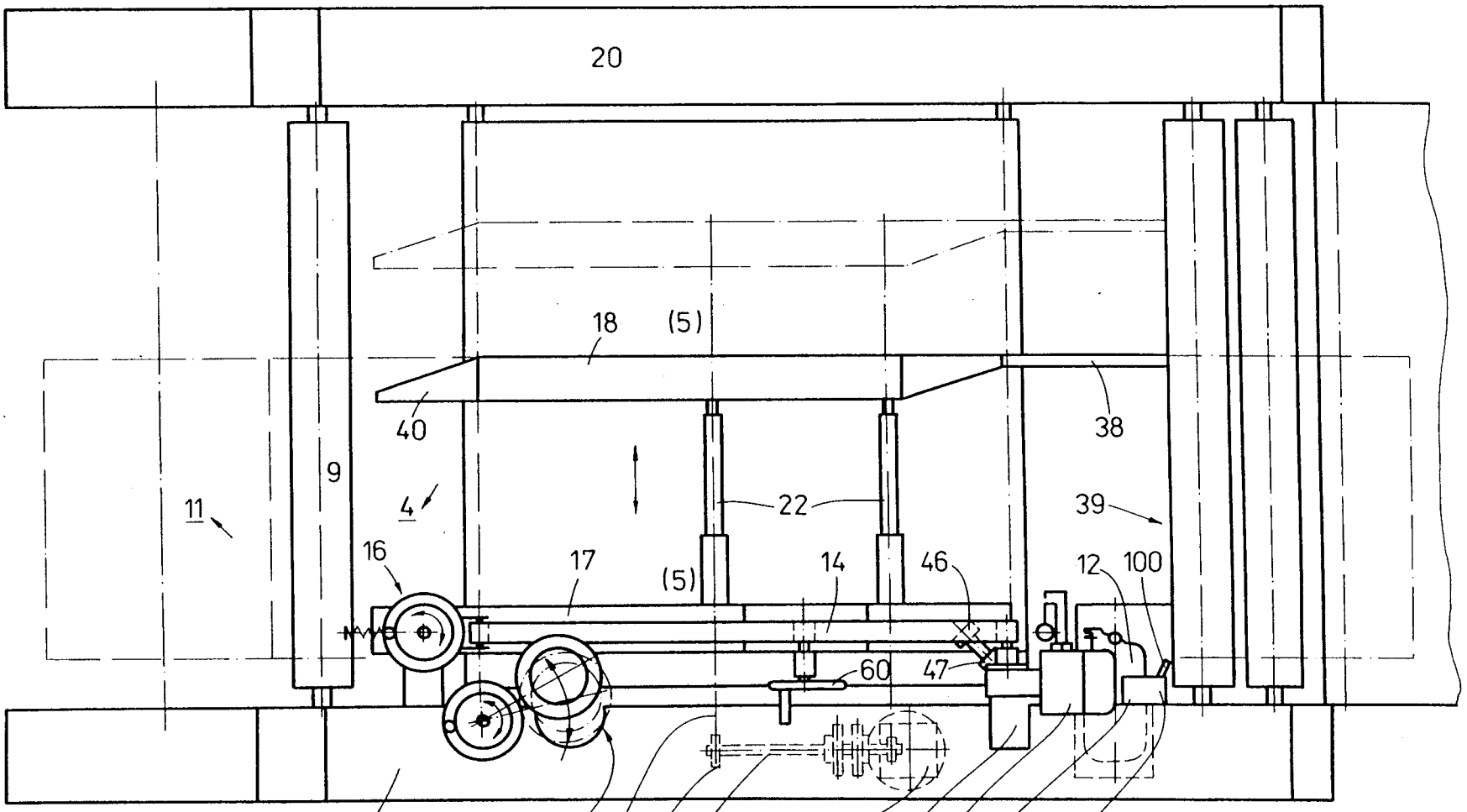
FIG. 2 is a top view of the apparatus of FIG. 1.

As may best be seen from FIGS. 2 and 4, the spreader 5 has two longitudinal guide members which are generally U-shaped in transverse cross-section and are comprised of sheet metal or cast light metal, the guide members being namely an inner guide member 17 and an outer guide member 18. The inner guide member 17 is mounted to the inner support 19 in such a way (not illustrated) that it can be moved vertically to some extent. The outer guide member 18 is attached to the free ends 21 of two telescoping tubes 22, the respective opposite ends of which are rigidly fixed to the inner support 19, such that the tubes are bowed slightly under the weight of the outer guide member 18. The telescoping tubes 22 each have a helical compression spring 23 (FIG. 4) disposed inside them, which spring abuts the inner tube segment 24 and extends to the inner end of the outer tube segment 25. The springs serve to apply a stress to the tubes 22 which tends to extend the telescoping tubes 22.

A respective wire cable furnishing a tensile means 26 is connected to the free end 21 of each telescoping tube 22, which cable is lead over and passes over two redirecting rollers 27, 28 to a cable pulley 29.

The cable pulleys 29 for both of the wire cables are mounted on a single common positioning member, such as a shaft 30. The shaft 30 in turn is connected to a drive motor 32 via a belt or chain drive 31 or the like. Thereby, the spreader 5 can be spread or contracted by pushbutton controls.

Both guide members have U-shaped cross-sections, as can best be seen from the representation of the outer guide member 18 in FIG. 4, including a web element 36 and two flange elements 37. At the release end, the U-profile undergoes a transition to a strip 38 (FIG. 2) which projects for a substantial distance, namely up to the guide rolls 39 to which the fabric is transferred before going to the winding roll 7.

The feed end of each of the two guide members 17 (FIGS. 2, 3), 18 (FIG. 2) bears an engaging projection 40. A cutting device 41 (FIGS. 1, 2, 3, 3*a*, 7) is disposed between the engaging projections 40 and the next telescoping tube 22. The motor shaft 42 of the cutting device 41 is adapted to be able to bear either a single circular knife 43 (FIG. 3) or two circular knives 44 (FIG. 3*a*) at a certain axial separation. The web element 36 of the inner guide member 17 has three parallel openings 45 in it to enable the knives 43 or 44 to penetrate.

The entire cutting device 41 with its bearing plate 78 can be swung around the axis 79 (FIGS. 3, 3*a*), and its height level is adjustable relative to the web element 36.

Figure 3:
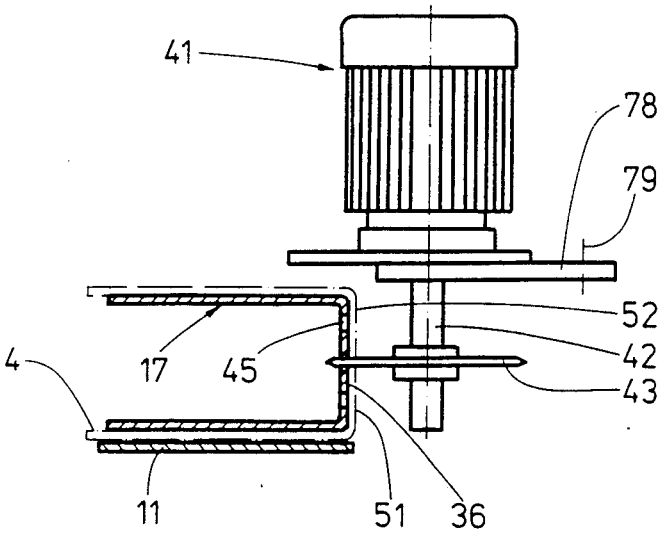
FIG. 3 is a partial cross section through line III—III of FIG. 1, with a single circular knife being illustrated.
Figure 3A:
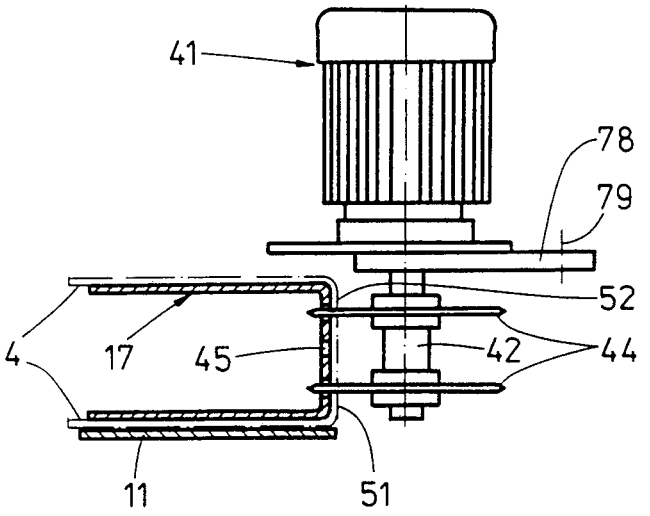
FIG. 3*a* is a refinement of the configuration shown in FIG. 3, with two circular knives on a single shaft.
Figure 3B:
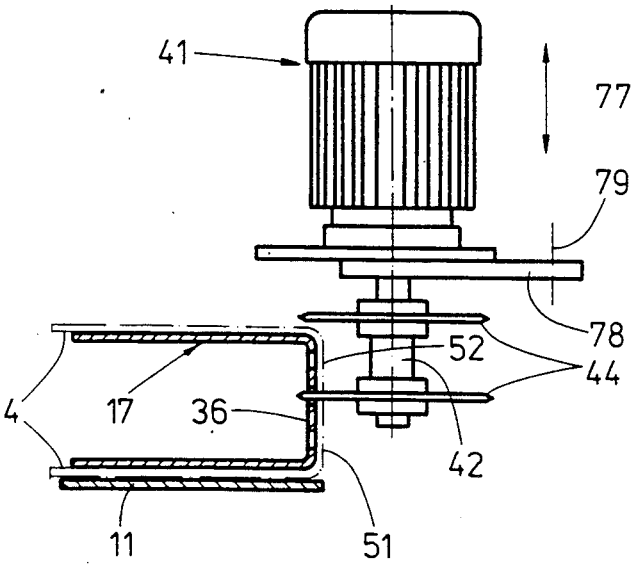
FIG. 3*b* is a refinement of the configuration shown in FIG. 3, with operating one of two circular knives on a single shaft.
Figure 7:
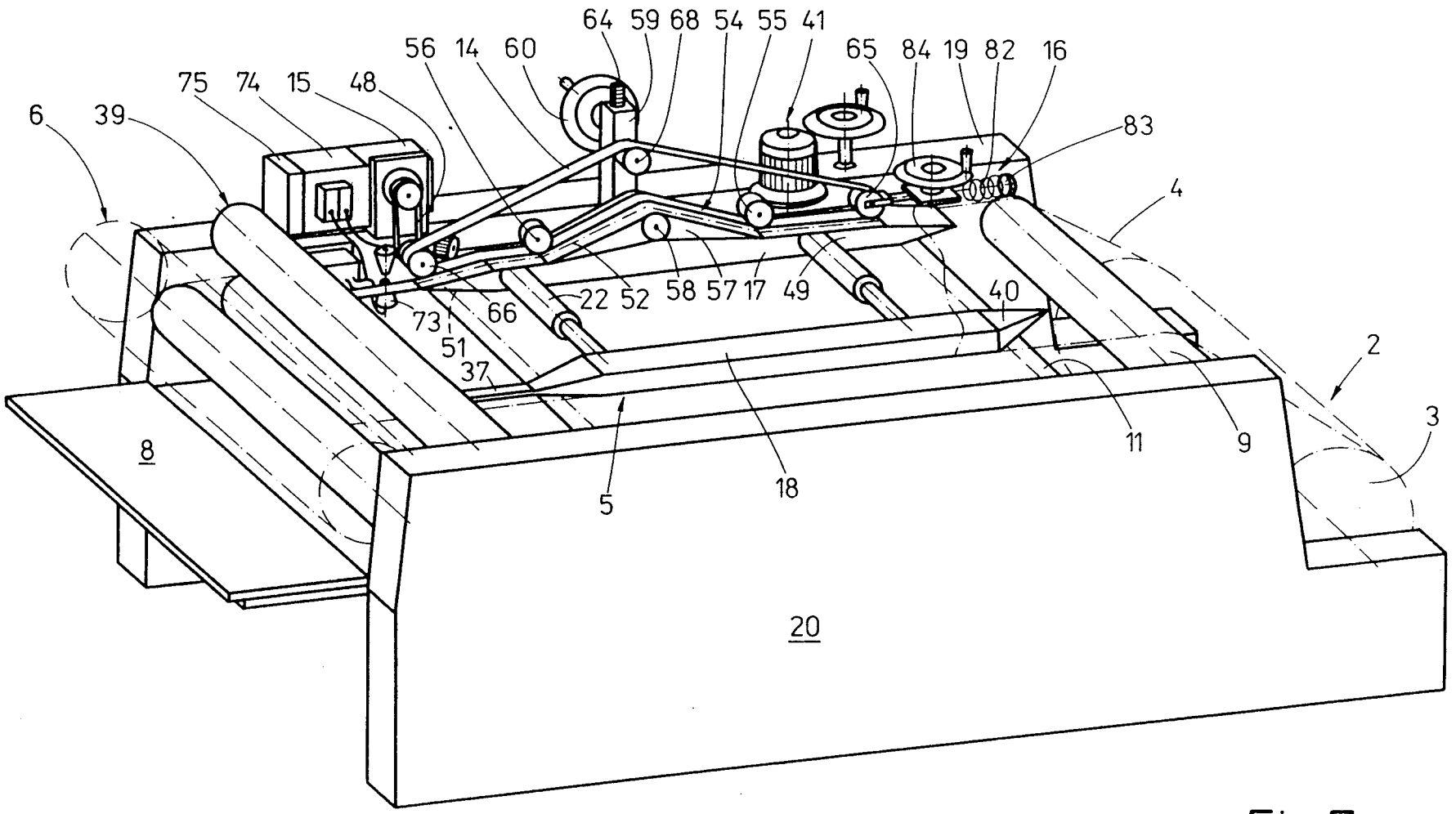
FIG. 7 is a perspective view of the invention apparatus.

If the cutting device 41 is shifted from the position illustrated in FIG. 3*a* according to the double arrow 77 of FIG. 3*b* into the position illustrated in FIG. 3*b*, then the lower circular knife 44 is positioned at the level of the middle parallel slot opening 45, while the upper circular knife 44 comes to rest above the inner guide member 17 at a sufficient distance, and thus is not able to cut into the tubular fabric 4.

One or two parallel slots can be cut into the tubular fabric 4 with the structure according to FIG. 3*b* by a mere adjustment of height level of the cutting device 41 without any one of the two circular knives 44 having to be turned on the motor shaft 42.

Before beginning the operation, the front end of the tubular fabric is withdrawn from the supply roll 3, placed over the supporting roll 9 and, with the outer guide member 18 retracted, the fabric is slid over the engaging projection 40 of the spreader 5 until the front end of the tubular fabric reaches the rear telescopic tube 22, i.e., the right-most such tube 22 in FIG. 2. In this connection, advantageously the tubular fabric is provided in advance with a longitudinal slit 49 (FIG. 1) extending from its front end backward toward the supply roll beyond the region of the cutting device 41, which slit 49 is disposed in the plane of the circular knife 43. Initially, the circular knife 43 is disposed in a position in which it is swung out of the path of movement of the tubular fabric. The longitudinal slit 49 has formed already a lower slit edge 51 and an upper slit edge 52 (FIGS. 5, 6). The lower slit edge 51 lies on the support band 11 and is placed under stress by the inner guide member 17. The upper slit edge 52 lies on the upper side 63 (FIG. 6) of the inner guide member 17.

Absent a deflecting device 54 (FIGS. 1, 4, 6), the relation between the two slit edges would remain that of defining an axial spiral. The deflecting device 54 (FIGS. 1, 4, 6) is disposed between the deflecting rolls 55 and 56, which are rotatably supported on bearing axles 551, 561 and where the deflecting device 54 serves to deflect the upper slit edge 52. Deflecting device 54 is furnished with two wedge-shaped inclined levers 57, as shown in FIG. 6. These are disposed on a common pivot bearing 58. Each lever 57 has a sharp edge 50 on its free end, which ed9e rests on the upper side 63 of the inner guide member 17. The bearing 58 is mounted on a vertical bar 59 which is vertically movable relative to arrows 62 and fixable, with respect to a support member 61, shown in FIG. 4 attached to the machine frame. The movement of the vertical bar 59 is accomplished with the aid of a hand wheel 60 or the like.

A scale 64, shown in FIG. 4, is provided for adjusting the height level of the bearing 58, and thus the deflection height h, above the upper side 63 of the inner guide member 17 (FIG. 6). The pressure band 14, lying over the upper slit edge 52, runs between the two redirecting rolls 65, 66 in the same direction, rightward in FIG. 1, and over the redirecting roll 68 (FIGS. 1, 7) disposed above the deflecting device 54, which roll 68 can in principle be affixed to the machine frame, but which, in the embodiment illustrated,.is mounted on the bar 59.

The deflection height h is adjustable based on the spiral pitch on the tubular fabric, and in particular is based on the number and width of the individual stitch paths. After a short test run, this can be adjusted as conditions require by operating the hand wheel 60. The resulting mutual displacement will then normally be retained in further operation. Automatic means may also be employed to perform the corrections of the deflection height h, in response to some sensed quantities which deviate from a set point. Thus, the mechanical hand adjustment illustrated may be replaced by a motor drive operation which may be acted on by the control system 75 mentioned infra.

The tensioning device 16 for the pressure band 14 exhibits a tubular guide casing 80 for a rod 81. The rod 81 supports at its front end, disposed toward the right in FIG. 1, the deflection roller 65. The rear end of the rod 81 is connected by a pull spring 82 to a connection part 83 fixed to the casing and thereby assures easily a slight tension to the pressure band 14. However, the rod 81 can be shifted to the left at the guide tube 80, disposed fixed relative to the casing, by way of a hand wheel 84 and a transformer drive, not recognizable from the drawing. This releases the pull spring 82 and increases the tension of the pressure band 14 by way of the deflection roller 65. The connection part 83 can be adjusted in the same way, in case where the connection part 83 is disposed shiftable and connected with the rod 81 via the pull spring 82.

The deflection roller 66 rests rotatably on its axle 661 as illustrated in FIG. 5. The axle 661 is fixedly attached to an inner support 19. The second advancing motor 15 is connected via the support 69 to the angle drive 85 and the drive belt 48 for the deflection roller 66 starts at the take-off output shaft 86 of the angle gear 85.

The connection of the scanning device 73 to the comparator means 74 via a light guide cable 104 can be recognized in FIG. 5.

A rotating brush 46, shown in FIG. 2, serving as a strip roll, i.e. a "brushing roll" or "spreading roll", is driven via friction roll 47, which is driven by, for example, the drive belt 48 (FIG. 1) of the second advancing motor 15 (FIG. 2) for the pressure band 14 (FIG. 2).

In this way, the outer part of the upper slit edge 52 is brushed in the outward direction away from guide member 18 to counteract any pulling of the said slit edge toward the outer guide member 18.

The pulling out of the slit edge is further counteracted by rollers gripping over the upper slot edge 52. In particular, the rollers 55, 56 run on the pressure band 14 over a rectangular groove 53 recessed into the upper side of the inner guide member 17. The rollers 55, 56 thereby deform the upper slit edge 52 in this rectangular groove 53. A reliable longitudinal guiding of the upper slit edge 52 at the pressure band 14 is achieved in this manner and the danger of a cross-motion is eliminated.

The two slit edges 51, 52 are conveyed further in tandem between the redirecting rolls 66, 67 of the pressure band 14 and a conveying device 11, such as a support band, respectively, and are passed through the sewing machine 12 (FIG. 2) and an adjoining checking device 71, and further through the guide rolls 39, to the winding roll 7. The checking device 71 is formed in principle by an end switch having a sensing lever 100 resting from the outside at the seam connecting the two slit edges 51, 52. If the checking device 71, which is equipped with a transducer, encounters and senses a defect or weak spot in the completed seam, then the sensing lever swings under spring pressure inwardly into the defective location and the sensing lever actuates a signal transducer 101 and shuts off the main motor 10.

To simplify the adjustment of the mutual displacement of the two slit edges 51, 52, contactless sensing devices 72, 73 (FIG. 1) can be provided on both, upper and lower, sides of said edges as said edges advance in tandem. Sensing devices 72 and 73 are connected to a comparator 74 and a control system 75. This control system 75 controls the second advancing motor 15, based on a residual deviating mutual displacement of the two slit edges, which changes the speed of the upper slit edge 52 driven by motor 15 via pressure band 14. The automatically controlled adjustment can operate continuously or discontinuously.

As a rule, light/dark sensors are sufficient. However, if a striped tubular fabric is used which has different colors which have approximately equal light intensity, color sensors should be used which directly detect the boundaries between neighboring colored stripes and perform precise control in accordance therewith.

Figure 9:
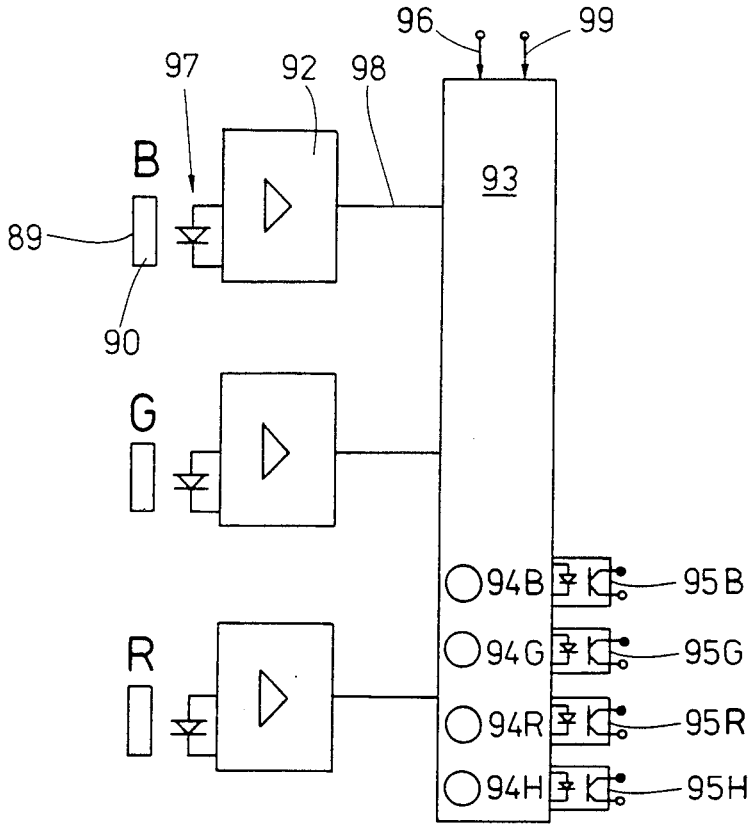
FIG. 9 is a schematic circuit diagram for a scanning device with a sensor.

Three color channels B (blue), G (green) and R (red) are provided in the circuit diagram of FIG. 9. They can be subjected to a joint illumination or alternatively to separate and adjustable illuminations 89 with neutral white light, which white light is then passed through a color filter 90 of the respective base color, and then a color recognition device 91 responds in each channel and furnishes at two connector terminals a color signal, which is then amplified in the amplifier 92 and is then transmitted to an evaluation electronics 93.

A set point adjuster 94B, 94G, 94R is coordinated and connected to each of the three output terminals 95B, 95G, 95R for a respective base color B, G, R. A brightness measurement value is signalled at the output terminal 95H derived from the individual color values.

The individual components can be preset for each color tint by way of a set point adjuster 94B, 94G, 94R. The only thing then to be observed and recognized is whether this resulting tint is observed and identified, which deviations are present, where a tolerance value can be entered at the terminal 96 and where an intensity value can be entered at the terminal 99. The individual color values of the base colors are advantageously controlled by a potentiometer. The connections from the color recognition device 91 to the amplifier 92 and from the amplifier 92 to the evaluation electronics 93 are all effected with optical fiber guides or optical fiber cables 97, 98.

As an alternative to the second advancing motor 15 being tightly connected to the roll 66 via the belt 48, a superimposed drive may be provided, possibly having a differential transmission. However, it appears more advantageous to use a stepping motor, wherewith depending on the mutual displacement of the two slit edges a different number of control pulses is sent to said motor.

As a rule, the unitary tubular fabric is only slit once with the circular knife 43, as shown in FIG. 3. In contrast, two circular knives are displaced toward the top and bottom extremities according to the embodiment shown in cross-section by FIG. 3*a*. This enables excision of wider intermediate strips, in cases where, for some reason, it has been necessary to use an edge part including ladders or dropped stitches or the like, which now have to be cut out.

The overlock seam, lapping stitch seam, serged seam, overcast or whipped seam, produced by the sewing machine, has advantage that the slit edges 51, 52 having been brought together and superposed, can be sewed together in this doubled condition and then can be swung out around the common edge and joined together a second time from the front side. This is accomplished without special operations in the further course of the operation.

Figure 10:
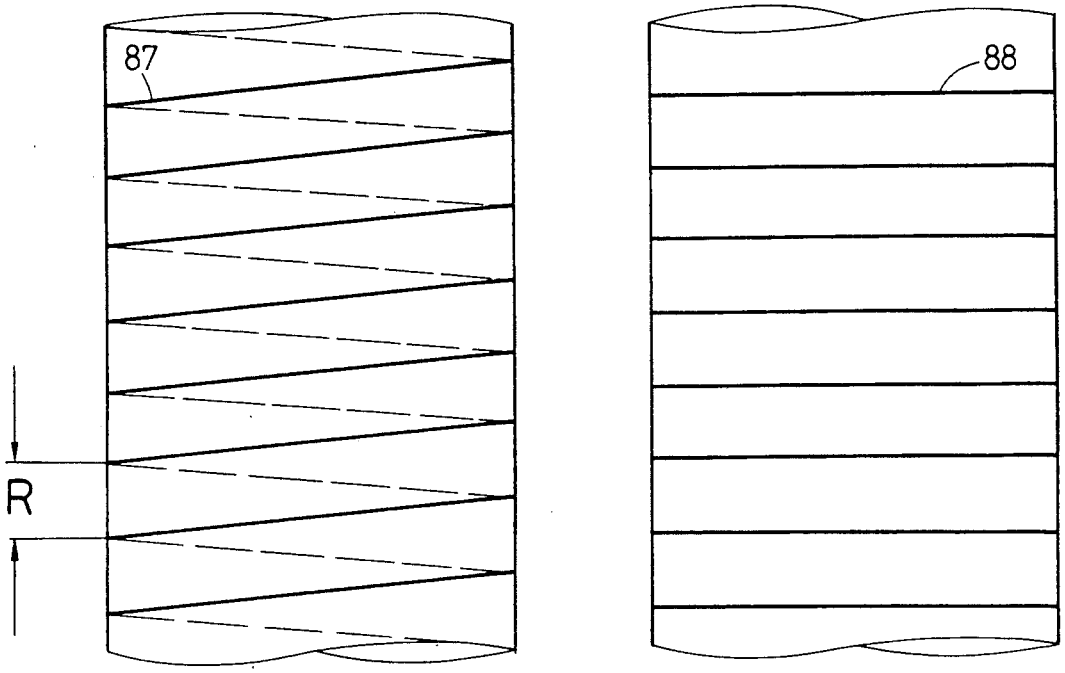
FIG. 10 is a schematic view of a spiral mesh track, on the left before and on the right after the axial staggering of the slot edges.

As a rule, the entire repeating pattern of the design of FIG. 10, Rapport R, will be compensated for. The spiral form of a certain course of a thread is illustrated as a zig-zag line 87 in the left hand side of this FIG. 10 in a simplified drawing representation. In contrast, the right-hand part of FIG. 10 illustrates the course of, in principle, the same line after the staggering of the two slot edges 51, 52 in longitudinal direction around the rapport R repeat of design followed by sewing together. All lines running up to this point as a spiral are formed thereby as circumferential lines 88, which all run cross to the longitudinal direction of the tube.

However, it is possible that one will desire only to change the pitch of the spirals, wherewith only a part of the original mutual displacement will be eliminated. This mutual displacement can be sensed continuously or discontinuously, with accompanying continuous or discontinuous correction being carried out. It is basically possible to perform the corrections exclusively by changing the deflection path of the pressure band, by, for example, displacing the position of the pivot bearing 58 by motorized means influenced by the control system 75.

Another possibility for the corrections is to exclusively change the speed of one of the slit edges with respect to the other until they near the point of tandem advancement, whereby, for example, exactly one pitch of the spiral is compensated for. In such a case, linear guide means may be used, although under certain conditions an intermediate transverse deflection may be needed to maintain the conveying stress.

An alternative to sensing the normal stitch path is to provide special transducers, for example, having radiative or metallic conductive material, which are incorporated in the longitudinal wall of, for example, the spreader, which sense a fiber comprised of signal material which is incorporated into a spiral stitch path.

While, as a rule, the focus of the instrumentation technique is on the actual mutual displacement of the two slit edges, it is also possible to employ measurements of the difference in the individual displacements, or the changes in said difference. In general, this also yields the direction of the correction. The direction of the correction may also be obtained from a comparison of two sequential sensing events.

It will be understood that each of the elements described above, or two or more together, may also find a useful application in other tubular fabric processing machines and in edge-joining processes differing from the types described above.

While the invention has been illustrated and described as embodied in the context of a method and apparatus for changing the spiral stitch path in a tubular fabric, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method for changing a spiral stitch path in a tubular fabric such as a striped fabric produced on a circular knitting machine, comprising the following steps:

continuously advancing a tubular fabric in its longitudinal direction over an inner guide means;

cutting the tubular fabric along a longitudinal straightline, forming two slit edges;

advancing the two slit edges, employing two separate advancing mechanisms;

mutually displacing the two slit edges in the longitudinal direction;

moving said edges together in a direction transverse to said longitudinal direction;

further advancing said edges in tandem, rejoining said edges in a position resulting from the mutual displacing of the two slit edges in said longitudinal direction; checking the connection immediately after the rejoining of the two slit edges and, generating a signal and interrupting the advancing movement of the tubular fabric in the event the checking reveals a defect in the rejoining of the two slit edges.

2. The method according to claim 1 further comprising:

sensing mutually corresponding design features of the two slit edges in a plane transverse to the advance direction; and producing a correction signal which is based on the magnitude or the direction of the deviations of the two respective design features.

3. The method according to claim 2, wherein at least individual points of the stitch path between different color properties, originally spiral transverse stripe configurations, are sensed.

4. The method according to claim 3, wherein visible color properties and sensed fields of the two respective transverse stripe configurations are detected.

5. The method according to claim 1, wherein special signal-producing elements, comprised of materials incorporating highly sensitive electrons, are incorporated in the longitudinal edges.

6. The method according to claim 1, wherein at least one thread or yarn of signal material is incorporated into the spiral stitch path.

7. A method for changing a spiral stitch path in a tubular fabric such as a striped fabric produced on a circular knitting machine, comprising the following steps:

a) continuously advancing the tubular fabric in its longitudinal direction over an inner guide means;

b) cutting the tubular fabric along a longitudinal straight line, forming two slit edges;

c) advancing the two slit edges, employing two separate advancing mechanisms;

d) mutually displacing the two slit edges in the longitudinal direction;

e) moving said edges together in a direction transverse to a direction of advance;

f) further advancing said edges in tandem, wherein said edges are rejoined during said advancing into a position resulting from a longitudinal displacement;

g) checking a connection between the two slit edges after the rejoining of the two slit edges and generating a signal and interrupting the advancing movement of the tubular fabric if the checking indicates a defect in the rejoining of the two slit edges.

8. The method according to claim 7 further comprising:

a) sensing mutually corresponding design features of the two slit edges in a plane transverse to the advance direction; and b) producing a correction signal which is based on the features of deviations of the two respective design features.

9. The method according to claim 8, further comprising:

sensing at least individual points of the stitch paths between different color properties, originally spiral transverse striped configurations.

10. The method according to claim 7, further comprising:

detecting the visible color properties in the sensed fields of the two respective transverse stripe configurations qualitatively and quantitatively.

11. The method according to claim 7, further comprising:

incorporating in the longitudinal edges special signal-producing elements, comprised of materials incorporating highly sensitive electrons.

12. The method according to claim 11, further comprising: incorporating at least one thread or yarn of signal material into a spiral stitch path.

13. The method according to claim 7, further comprising:

adjusting the mutual displacement to a longitudinally repeating pattern of a design in accordance with the pitch of the spiral stitch path;

adjusting the mutual displacement depending on the number of stitch loops in the repeating pattern of a design;

wherein the mutual displacement is:

a) sensed during operation, b) compared with a preset value, and c) corrected in accordance with the remaining deviation difference;

correcting the difference in displacements by changes in the difference in the lengths of the conveying paths of the two slit edges;

producing the mutual displacement, by at least a change in the speed of advance of at least one of the two slit edges;

wherein the sensing is performed by optical means;

switching a photocell or darkness-switch system between light and dark depending on the type of configurations to be sensed;

bringing back together the two temporarily separated slit edges in a mutually abutting position and subsequently rejoining the two abutting edges;

sewing together the slit edges, particularly by means of an overlock seam or loop seam.

14. A method for changing a spiral stitch path in a tubular striped fabric produced on a circular knitting machine, said method comprising the steps of:

continuously advancing the tubular fabric in its longitudinal direction over an inner guide;

spreading the tubular fabric with a spreader engaging the tubular fabric from the inside;

forming two slit edges by cutting the tubular fabric along the longitudinal straight line;

using separate advancing mechanisms for advancing the two slit edges on the basis of different speeds of advance and different distances of advance, whereby the two cut edges experience mutual displacement in a longitudinal direction; moving the edges in a direction transverse to said longitudinal direction;

rejoining the slit edges in a configuration resulting from said mutual displacement while advancing the edges in tandem; and monitoring the rejoining of the two slit edges immediately following the rejoining, and generating a signal in the event the monitoring reveals a defect in the rejoining of the two slit edges.

15. An apparatus for changing a spiral stitch path in a tubular fabric such as a striped fabric produced on a circular knitting machine comprising:

an apparatus frame;

an inner guide means attached to the apparatus frame for supporting the tubular fabric;

a conveying device for continuously conveying the tubular fabric over the inner guide member;

a cutting device, mounted in the region of the inner guide member, for slitting the tubular fabric in the direction of advance of said fabric;

separate guide means for guiding each of the two slit edges, which edges border a longitudinal slit, such as to produce a mutual displacement of said edges from a previous mutual position, said guide means further serving for tandem conveying of the slit edges in the direction of said mutual displacement;

a joining device for rejoining the slit edges to form a seam joint, after they have been brought back together, to re-form a tubular configuration during the tandem conveying;

a seam-checking device including a signal transducer generator, where the signal transducer generator is disposed upstream with respect to the joining device, wherein the signal transducer generator is actuated when a defect in the seam joint is recognized; and control means actuated by signals of the said signal transducer generator for controlling a shutoff of the operation and of respective parts of the apparatus.

16. The apparatus according to claim 15 further comprising:

sensing means for sensing the actual mutual displacement of the slit edges of the fabric;

comparator means for comparing the actual displacement with a preset value; and correcting means for automatically correcting and adjusting the mutual displacement to match said preset value.

17. The apparatus according to claim 16, wherein the sensing means comprises:

at least two sensing elements, wherein said sensing elements provide contact-free sensing of mutually corresponding features of the two slit edges of the fabric.

18. The apparatus according to claim 17, wherein said sensing elements are color sensors.

19. The apparatus according to claim 17 wherein one of the sensing elements is disposed and adapted for sensing a radiation corresponding to a radiation condition defined by the members of the group consisting of a) radiation outside a visible range, b) radiation derived from special signaling elements associated with the tubular fabric, c) extrinsic radiation relative to said signaling elements, which radiation is modified by said signaling elements, extrinsic radiation relative to said signaling elements, which radiation is deflected by said signaling elements, and e) extrinsic radiation relative to said signaling elements, which radiation is diffracted by said signaling elements.

20. The apparatus according to claim 15, wherein the inner guide means comprises:

a spreader attached to the frame having two lateral guide members, which lateral guide members are mutually adjustable transversely to the advance direction, over a support surface, wherewith one of the two lateral guide members, the inner guide member, is associated with the machine frame, and wherein said inner guide member has at least one opening extending in the conveying advance direction;

wherein the cutting device includes a slitting knife of the cutting device capable of extending through a wall of the inner guide member at the location of said opening.

21. The apparatus according to claim 20 wherein the inner guide member is directly affixed to the machine frame; and further comprising:

the inner guide member is directly affixed to the machine frame; and further comprising:

cantilever telescoping tubes connecting an outer guide member to said inner guide member, which cantilever telescoping tubes extend transversely from said inner guide member; and compression springs disposed on said telescoping tubes, wherein the compression springs are disposed such as to separate the inner guide member from the outer guide member.

22. The apparatus according to claim 21 further comprising:

two flexible tensile means being connected to the outer guide member, wherein the flexible means are guidable outwardly via the telescoping tubes; and a common position member drivable by a positioning motor, wherein said tensile means are connected to the common positioning member.

23. The apparatus according to claim 20 further comprising:

a circular knife forming a rotating slitting knife incorporated in the cutting device;

a slitting motor driving said knife in rotation; and a guide for movably guiding said circular knife into the tubular fabric along a guiding path running parallel to a plane of the circular knife.

24. The apparatus according to claim 21, wherein the inner guide member is in the form of a concave element which is open toward the outer guide member, wherein said inner guide member is made up of a material capable of retaining its shape, and wherein the wall of the concave element has incorporated therein three parallel, slit-shaped penetrating openings for allowing an alternative machine operation by producing either a longitudinal slit in the tubular fabric corresponding to a center opening of the three parallel slit-shaped penetrating openings, or two longitudinal slits in the tubular fabric corresponding to two outer openings of the three parallel slit-shaped penetrating openings, such that, upon cutting of the tubular fabric, the slits generated are separated by a specified transverse distance approximately related to the distance of the two outer openings.

25. The apparatus according to claim 20 further comprising:

a wide support band mounted under a moving region of the spreader, wherein said band is driven, in particular, at a conveying speed of the tubular fabric, and wherein a lower slit edge is held from above against said support band by the weight of the spreader; and a special upper advancing means, wherein an upper slit edge is pressed against an upper side of the inner guide member by the special upper advancing means.

26. The apparatus according to claim 25 further comprising:

an endless flexible tensile device incorporated into the upper advancing means;

a tensioning device for placing the endless flexible tensile device under tension, and wherein a lower surface of the endless flexible tensile device lies on the upper slit edge of the tubular fabric, which upper slit edge lies on the inner guide member of the spreader.

27. The apparatus according to claim 26 further comprising:

a main support face for the endless flexible tensile device; two redirecting rolls for the endless flexible tensile device, wherein the endless flexible tensile device is formed by a flat pressure band, and wherein the lower surface of the pressure band is guided between the two redirecting rolls over a deflecting projection, which extends transversely away from the main support face, whereby a deflection path of the upper advancing means results with respect to the conveying path of the supporting band, thereby producing a mutual longitudinal displacement between the two slit edges.

28. The apparatus according to claim 27, wherein:

the deflecting projection is formed by a double-incline, inverted V configuration with a rounded intersection on top; and further comprising:

two generally wedge-shaped, inclined levers maintained with their thicker, rounded ends pivoted around an axis extending transversely to a main direction of advance, with said levers being mounted in a common pivot bearing, and wherein each lever has a sharp edge on its free end, which sharp edge lies under the upper slit edge and rests on the inner guide member of the spreader.

29. The apparatus according to claim 28, wherein the pivot bearing is adjustably disposed with respect to a support element for the upper slit edge.

30. The apparatus according to claim 27 further comprising:

a brushing and spreading roll associated with the upper slit edge, wherein said roll is acting on said upper edge in the direction of action, whereby said upper end is urged away from the outer guide member.

31. An apparatus for changing a spiral stitch path in a tubular fabric such as a striped fabric produced on a circular knitting machine comprising:

a) a machine frame (1), wherein the frame (1) includes:

b) an inner guide means (17, 18) for the tubular fabric (4);

c) at least one conveying device (11) for continuously conveying the tubular fabric over the inner guide means (17, 18);

d) a cutting device (41), mounted in the region of the inner guide means (17, 18), for slitting the tubular fabric (4) in the direction of advance of said fabric forming two slit edges (51,52) bordering a longitudinal slit (49), wherein separate guide means guide each of the two slit edges (51,52) over conveying paths, which are of different lenths, and wherein said separate guide means guide said edges at disparate speeds, in order to produce a mutual displacement of said edges (51,52) from their previous mutual position, and wherein said guide means further serves for subsequent tandem conveying of the slit edges in the mutually displaced relation;

f) sewing machine (12) for rejoining the slit edges (51, 52) to form a seam joint, after the slit edges have been brought back together, to re-form a tubular configuration, during the further conveying;

g) sewing machine (12) is connected to a seam-checking device (71) having a signal transducer generator;

h) said signal transducer generator being actuated when a defect in the seam joint is recognized; and i) said signal transducer generator being adapted to control a shutoff of at least a part of the apparatus.

32. The apparatus according to claim 31 further comprising:

a) sensing means (72, 73) for sensing the actual mutual displacement;

b) comparator means (74) for comparing the actual mutual displacement with a preset value; and c) control means (75) for correcting and adjusting the mutual displacement.

33. The apparatus according to claim 32, wherein the sensing means comprise:

a) at least two sensing elements (72, 73); and wherein b) said elements provide contact-free sensing of mutually corresponding features of the two slit edges (51, 52).

34. The apparatus according to claim 33, wherein said sensing elements are color sensors.

35. The apparatus according to claim 33 further comprising sensing elements for:

a) radiation outside a visible range;

b) radiation derived from special signaling elements incorporated into the tubular fabric (4);

c) extrinsic radiation relative to said signaling elements, which radiation is modified, deflected, and diffracted by said signaling elements.

36. The apparatus according to claim 31, wherein the inner guide means comprise:

a) a spreader (5) having two lateral guide members (17, 18);

b) which lateral guide members are mutually adjustable, transversely to the conveying direction, over a support surface (11); wherewith c) one of the two lateral guide members, the inner guide member (17), is associated with the machine frame (1); and d) said inner guide member (17) has at least one opening (45) extending in the conveying direction, whereby a slitting knife (43, 44) of the cutting device (41) may extend through a wall of the inner guide member at a location of said opening.

37. The apparatus according to claim 36, wherein:
a) said inner guide member (17) is directly affixed to the machine frame (1);
b) said inner guide member (17) is connected to an outer guide member (18) by cantilever telescoping tubes (22) which extend transversely from said inner guide member (17); and
c) said telescoping tubes bear compression springs which act between said inner and said outer guide members (17,18).

38. The apparatus according to claim 37 further comprising:
a) two flexible tensile means (26) connected to the outer guide member (18); wherein
b) said tensile means (26) are guidable outwardly via the telescoping tubes (22); and wherein
c) said tensile means are connected to a common positioning member (30) drivable by a positioning motor (32).

39. The apparatus according to claim 36 wherein:
a) the cutting device (41) includes a rotating slitting knife, which is a circular knife (43);
c) said knife is driven in rotation by a slitting motor; and
d) said knife is movably guided into the tubular fabric (4) along a guiding path running parallel to a plane of the knife.

40. The apparatus according to claim 37 wherein:
a) at least the inner guide member (17) is in the form of a concave element which is open toward the outer guide member (18);
b) said inner guide member (17) is comprised of shape-retentive material; and
c) a wall of the concave element forming the inner guide member (17) is provided with three parallel slit-shaped penetrating openings (45) for producing at least one longitudinal slit (49) in the tubular fabric (4), wherewith, in the case of two slits in the tubular fabric, the slits are separated by a specified transverse distance.

41. The apparatus according to claim 36 further comprising:
a) a wide support band (11) which is mounted under a moving region of the spreader (5);
b) said band which is driven, in particular, at a conveying speed of the tubular fabric (4); and wherein
c) a lower slit edge (51) is held from above against said support band (11) by the weight of the spreader (5); and
d) an upper slit edge (52) is pressed against an upper side of the inner guide member (17) by a special upper advancing means (14).

42. The apparatus according to claim 41 wherein:
a) the upper advancing means comprise an endless flexible tensile device (14);
b) the device (14) is placed under tension by a tensioning device; and
c) a lower surface of the tensile device (14) lies on the upper slit edge (52) of the tubular fabric (4), which edge lies on the inner guide member (17) of the spreader (5).

43. The apparatus according to claim 42 wherein:
a) the flexible tensile device (14) is a generally flat pressure band;
b) the lower surface of the band (14), is guided between two redirecting rolls over a deflecting projection (57, 58) which deflecting projection extends transversely away from a main support (63); whereby
c) a deflection path of the upper advancing means (14) results with respect to the conveying path of the support band, thereby producing a mutual longitudinal displacement between the two slit edges (51, 52).

44. The apparatus according to claim 43 wherein:
a) the deflecting projection is formed by a double-incline, inverted V configuration with a rounded intersection on top; and further comprising
b) two generally wedge-shaped, inclined levers (57) positioned with their thicker, rounded ends pivoted around an axis extending transversely to a main direction of advance, with said levers being mounted in a common pivot bearing (58); and wherein
c) each lever (57) has a sharp edge on its free end (50), which sharp edge lies under the upper slit edge and rests on the inner guide member (17) of the spreader.

45. The apparatus according to claim 43, wherein the pivot bearing (58) is adjustably disposed with respect to a support element (63, 17) for the upper slit edge (52).

46. The apparatus according to claim 41, wherein at least one brushing and spreading roll (46) is associated with the upper slit edge (52), said roll acting on said upper slit edge in a direction of action, whereby said upper slit edge is urged away from the outer guide member (18).

47. The apparatus according to claim 31, further comprising:
at least one adjusting device (47–60) to adjust the mutual displacement, particularly to adjust it to correspond to the pitch of the spiral stitch paths and to the number of stitch paths in a spiral pitch advance, respectively as well as to a longitudinally considered repeating pattern of a design;
wherein the adjusting device (57–60) changes the difference in length of the paths of advance of the two slit edges (51, 52) and forms a correcting means;
wherein the correcting means are capable of changing the speed of advance of at least one of the two slit edges (51, 52);
wherein:
a guide element is associated with at least one of the two slit edges (51, 52);
which guide element is adjustably movable transversely to a main direction of advance of the tubular fabric (4) and transversely to the support plane of the tubular fabric (4);
wherein the speed of the advancing drive (10, 15) of at least one of the two slit edges (51, 52) is automatically adjustable as a function of
the mutual displacement,
the change in the mutual displacement,
the rate of change of the mutual displacement; wherein for adjusting the mutual displacement, an additional control and adjusting device, (75) is provided; wherein this additional device is combined with the advancing drives (10, 15) for a slit edge, (51, 52) for having an additional effect added to that of the advancing drive (10, 15) for the slit edge (51, 52);
wherein said adjusting means also controls the direction of the adjustment;

wherein optical sensing elements (72, 73) are employed;

wherein sensing elements are brightness sensors;

wherein said knife shaft (42), bearing said slitting knife, bears mountings for at least two slitting knives which can be mounted at a distance apart from each other; and wherein the joining device comprises a sewing machine to produce an overlock seam or loop seam.

48. The method according to claim 1, wherein the two slit edges are advanced over two respective different distances.

49. The method according to claim 1, wherein the two slit edges are advanced at two respective different speeds.

50. The method according to claim 2, wherein at least two individual points of boundary lines between different color properties, originally spiral transverse striped configurations are sensed.

51. The method according to claim 8, further comprising sensing at least individual points of boundary lines between different color properties, originally spiral transverse striped configurations.

52. The apparatus according to claim 42, wherein the tensioning device is a spring.

53. The apparatus according to claim 42, wherein the tensioning device is a weight-loaded tensioning roll (65).

* * * * *